US005607225A

United States Patent [19]

Halvatzis

[11] Patent Number: 5,607,225

[45] **Date of Patent: *Mar. 4, 1997**

[54] DISPLAY LIGHTING FIXTURE AND METHOD OF USING SAME

[76] Inventor: George Halvatzis, 316 Princeton Ave., Jersey City, N.J. 07305

[ * ] Notice: The term of this patent shall not extend beyond the expiration date of Pat. No. 5,437,504.

[21] Appl. No.: 509,503

[22] Filed: Jul. 28, 1995

Related U.S. Application Data

[63] Continuation of Ser. No. 118,927, Sep. 9, 1993, Pat. No. 5,437,504.

[51] Int. Cl.[6] ..... A47F 11/10

[52] U.S. Cl. ..... 362/125; 362/217; 362/220; 362/382

[58] Field of Search ..... 362/125, 217, 362/220, 238, 240, 249, 250, 389, 397, 418, 382; 312/223.5

[56] References Cited

U.S. PATENT DOCUMENTS

| | | | |
|---|---|---|---|
| 953,425 | 3/1910 | Miller | 362/217 |
| 2,675,983 | 4/1954 | King | 362/397 |
| 4,748,545 | 5/1988 | Schmitt | 362/225 |
| 4,970,630 | 11/1990 | Mudrovich | 362/191 |
| 5,057,978 | 10/1991 | Conti | 362/125 |
| 5,437,504 | 8/1995 | Halvatzis | 362/125 |

*Primary Examiner*—Ira S. Lazarus
*Assistant Examiner*—Alan B. Cariaso
*Attorney, Agent, or Firm*—Hopgood, Calimafde, Kalil & Judlowe

[57] ABSTRACT

A display case lighting fixture supportable between the inner opposing wall surfaces of a display case. The display lighting fixture comprises a housing having a longitudinal extent and first and second housing end portions. Halogen-type light producing bulbs and reflectors are mounted in the housing in order to produce a lighting pattern within the interior of the display. The display lighting fixture includes first and second housing support elements which extend substantially along the longitudinal axial extent from said first and second housing end portions, respectively. The first and second housing support elements have first and second wall engaging portions, respectively, and each wall engaging portion is adapted to engage one inner opposing wall surface of the display case. Contained within housing end portions is a simple mechanism for reliably adjusting the position of the first and second housing support elements along the longitudinal extent so that the distance between the first and second wall engaging portions can be made substantially equal to the distance between the inner opposing wall surfaces. In this way, each wall engaging portion engages one inner opposing wall surface in order to support the display case lighting fixture therebetween.

4 Claims, 3 Drawing Sheets

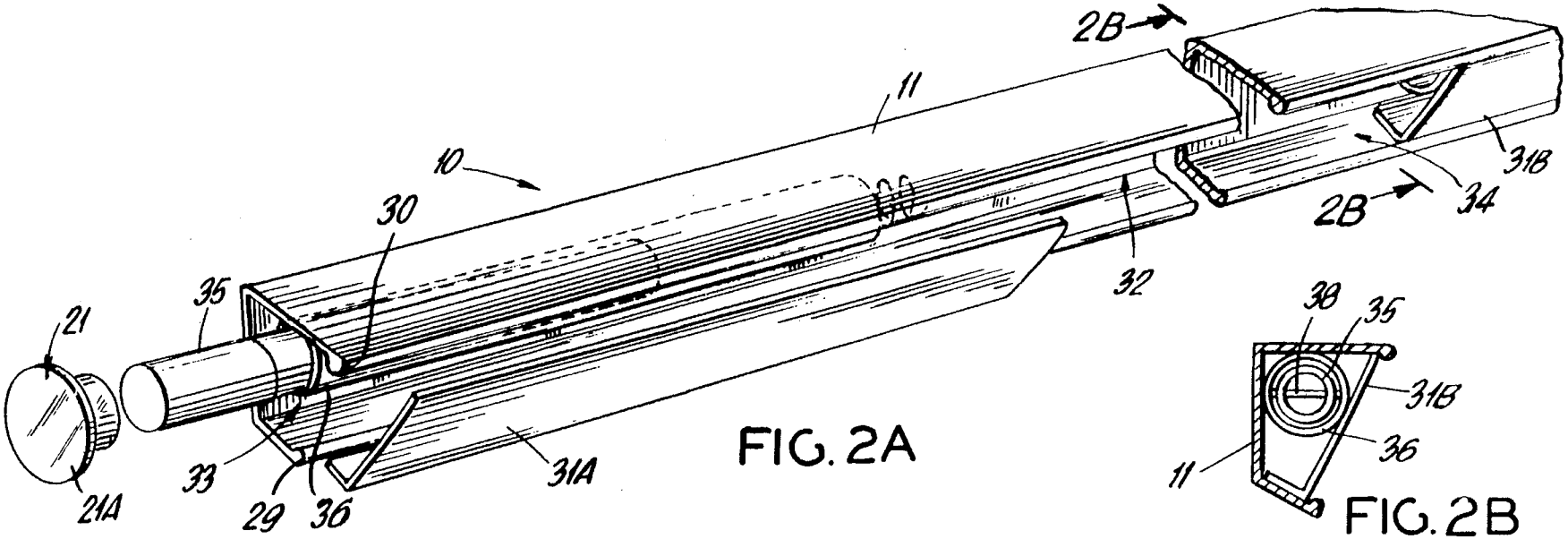
FIG. 2A
FIG. 2B
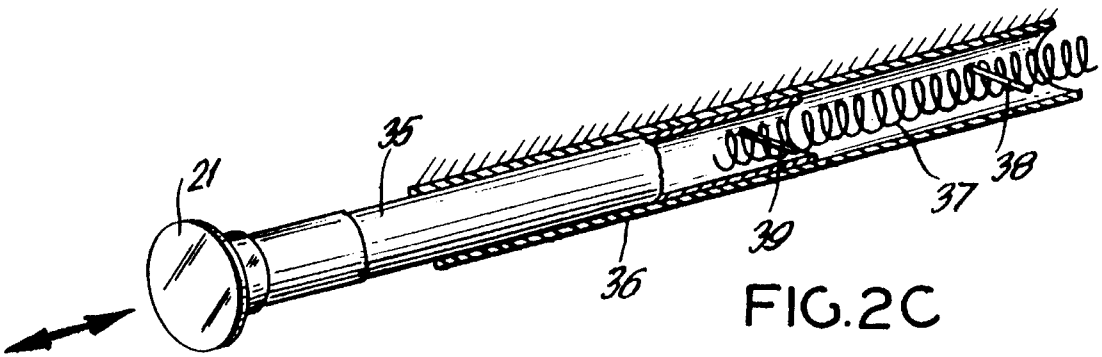
FIG. 2C

DISPLAY LIGHTING FIXTURE AND METHOD OF USING SAME

This is a continuation of application Ser. No. 08/118,927 entitled "Improved Display Lighting Fixture and Method of Using Same" filed Sep. 9, 1993, now U.S. Pat. No. 5,437,504.

BACKGROUND OF THE INVENTION

1. Field of the Invention

The present invention relates to an improved display case lighting fixture capable of installation within display cases of different sizes (e.g. length or width dimensions).

2. Brief Description of the Prior Art

Display case lighting fixtures allow merchants to illuminate their goods in an aesthetically pleasing manner that catches the desired attention of potential buyers. Non-commercial users may also employ such a lighting fixture to illuminate portions of furniture units or bookcases.

Prior art display case lighting fixtures have used a variety of different sources of illumination, including incandescent, fluorescent and halogen lamps.

In general, in order to install a display case lighting fixture, the installer must first determine the relevant dimensions of the display case, and only thereafter order a custom lighting fixture having a length commensurate with the measured display case dimension, e.g. usually its length.

Typically, the length and width of display cases (i.e. show cases) vary in accordance with manufacturer and model. Thus, the producers of prior art display case lighting fixtures have been required to either stock a wide range of display case lighting fixture lengths or custom manufacture display case lighting fixtures to conform to individual display case lengths. Such factors have increased the cost of prior art display case lighting fixtures, and at times have made their availability uncertain.

Few have addressed the problem of using a fixed length display lighting fixture in display cases of different sizes. In particular, U.S. Pat. No. 4,639,841 to Salestrom, et. al. discloses a modular lighting system that permits a user to construct a display case lighting fixture of variable length by snapping together a number of elongated lighting modules. While this technique allows for the construction of display case lighting fixtures of different lengths, it suffers from several shortcoming and drawbacks. Specifically, each module requires an electrical connector which increases the cost of manufacture, while posing the risk of electrical discontinuity and complete failure of all lighting modules.

Similarly constructed prior art display lighting fixtures can be found in U.S. Pat. Nos. 3,633,023 to Castiglioni; 4,070,594 to Fuchi; 4,413,311 to Orenstein; 4,488,082 Cummins; and 4,555,749 to Rifkin. However, such prior art fixtures also suffer from similar shortcomings and drawbacks discussed above.

Therefore, there is a great need for an improved lighting fixture capable of easy installation within display cases of varying sizes, while overcoming the shortcomings and drawbacks of prior art fixtures and methods.

OBJECTS AND SUMMARY OF THE INVENTION

Accordingly, it is a primary object of the present invention to provide an improved display case lighting fixture whose length may be easily adjusted for installation within display cases having different length or width dimensions, while overcoming the shortcomings and drawbacks of prior art display case lighting fixtures.

It is a further object of the present invention to provide such a display case lighting fixture having a housing with translatable support elements that can be easily adjusted so that the display case lighting fixture accommodates the inner dimensional distance between two opposing wall surfaces of a display case in order to support the display case lighting fixture therebetween.

It is a further object of the present invention to provide a display case lighting fixture that permits easy installation, repositioning and removal from a display case.

It is a further object of the present invention to provide such display case lighting fixture that is durable, reliable and capable of being manufactured at low cost.

It is further object of the present invention to provide a method of converting a conventional fluorescent-type display case lighting fixture into a halogen-type lighting fixture using the display case lighting fixture of the present invention.

It is further object of the present invention to provide a display case lighting fixture that can be installed within conventional fluorescent type display case lighting fixtures so as to provide intense incandescent illumination, without detracting from the appearance of the fluorescent lighting fixture or the illuminated goods.

These and further objects of the present invention will become apparent hereinafter.

BRIEF DESCRIPTION OF THE DRAWINGS

In order to more understand the Objects of the Present Invention, the Detailed Description of the Illustrative Embodiment of the Present Invention should be read in conjunction with the following drawings, in which:

FIG. 2A is an exploded, partially fragmented perspective view of a portion of the display case lighting fixture of the present invention, shown in FIG. 2;

FIG. 2B is cross-sectional view of the display case lighting fixture of the present invention, taken along 2B—2B of FIG. 2A;

FIG. 2C is a partially cut-away view of the housing support element of the illustrative embodiment of the present invention.

DETAILED DESCRIPTION OF THE ILLUSTRATED EMBODIMENT OF THE PRESENT INVENTION

In general, the display case lighting fixture of the present invention is particularly adapted for installation in a wide variety of conventional display cases. For illustrative purposes, the structural and functional characteristics of the display case lighting fixture of the present invention will be described with reference to an exemplary display case 1 shown in FIGS. 1 and 1A. Typically, the length and width dimensions of such display cases will vary according to model and manufacturer.

Figure 1:
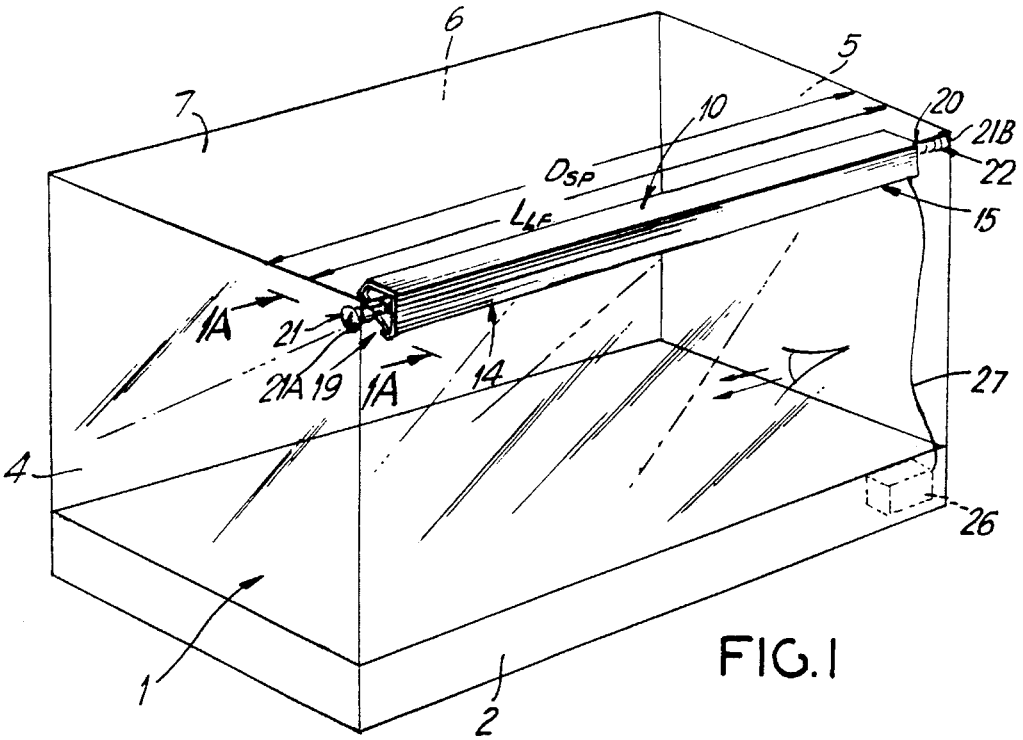
FIG. 1 is a perspective view of a conventional display case in which the display case lighting fixture of the present invention is installed.
Figure 1A:
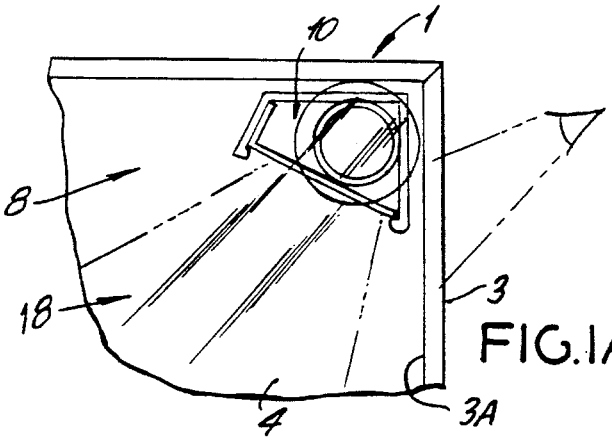
FIG. 1A is an elevated, partially fragmented end view of the conventional display case and display case lighting fixture of the present invention, taken along line 1A—1A of FIG. 1.

As shown, exemplary display case 1 comprises a number of panels, namely: an opaque base panel 2; opaque or optically transparent front wall viewing panel 3; opaque or optically transparent side wall panels 4 and 5; an opaque or optically transparent rear wall panel 6; and an optically transparent top viewing panel 7. Typically, these panels are held together by a frame (not shown) or other panel joining techniques known in the art. When assembled together as shown, each such panel has an inner wall surface (e.g. 3A, as shown in FIG. 1A) which faces the interior volume 8 enclosed by the above-described panels. Optionally, rear side wall panel 6 may be realized as a pair of siding doors to permit access into the interior volume of the display case for inserting, arranging and removing merchandise.

An illustrative embodiment of the display case lighting fixture of the present invention is shown in FIGS. 1A through 2C. The display case lighting fixture is indicated by reference numeral 10. As will become more apparent hereinafter, the length $L_{LF}$ of display case lighting fixture 10 can be easily adjusted so as to become substantially commensurate with the interpanel distance $D_{SP}$ measured between the inner wall surfaces of opposing side wall panels 4 and 5 of the display case. In this way, each commercial embodiment of the display case lighting fixture (having component dimensions fixed at a time of manufacture), can be easily mounted within a broad class of display cases without special modifications to the structure of these display cases or the display case lighting fixture itself.

Figure 2:
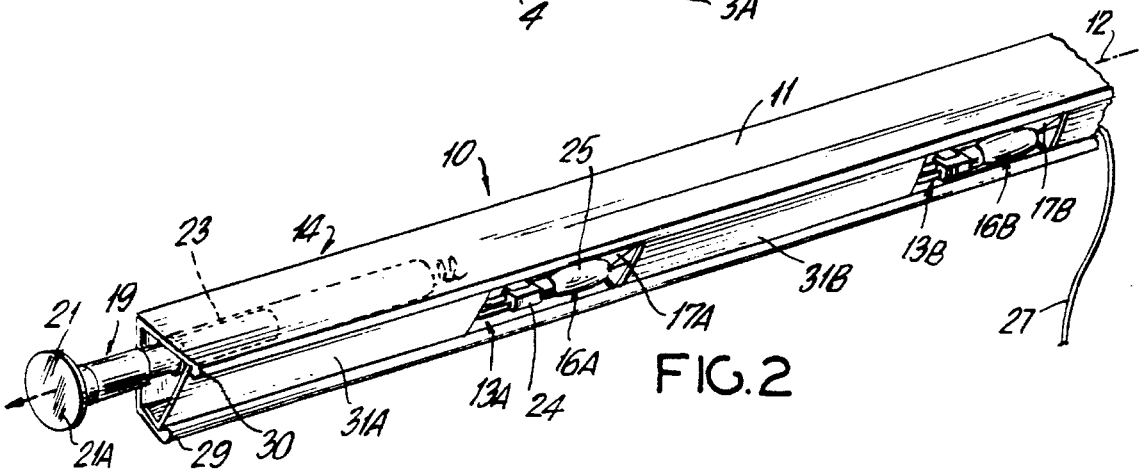
FIG. 2 is a perspective view of a potion of the display case lighting fixture of the present invention.

As illustrated more clearly in FIGS. 2 through 2C, display case lighting fixture 10 comprises an assembly of subcomponents, including a housing 11. As shown, housing 10 has a polygonal cross-sectional dimension extending along longitudinal axis 12, a plurality of housing apertures 13A, 13B . . ., and a first and second housing end portions 14 and 15. In an illustrative embodiment, five (5) halogen lighting devices might be employed, and thus a total of five housing apertures would be provided. As shown, a plurality of halogen-type light producing devices 16A, 16B . . ., are mounted within and along the housing for producing high intensity light from each such device. A plurality of light reflectors 17A, 17B . . ., are installed within housing apertures 13A, 13B . . ., respectively, and cooperate with light producing devices 16A, 16B . . ., respectively in order to focus light produced therefrom into a desire lighting pattern 18 defined external to the housing.

Extending from first and second housing end portions 14 and 15 are first and second housing support elements 19 and 20, respectively. Attached to the distal ends of these housing support elements are rubber (wall) surface engaging members 21 and 22, respectively, having planar side wall engaging surfaces 21A and 21B. Internal to the housing end portions are a pair of identically constructed mechanism(s) 23 which independently allow housing support elements 19 and 20 to be coaxially translated along the longitudinal axis of the housing. When the display case lighting fixture is mounted between the inner surfaces of opposing side wall panels 4 and 5 of the display case, housing support elements 19 and 20 are maintained at their selected positions along longitudinal axis 12. When disposed in such a mounting position, the spacing $L_{LF}$ between side wall engaging members 21 and 22 can be adjusted so that it equals the interpanel distance $D_{SP}$ between opposing side wall panels 4 and 5, or as in the preferred embodiment, so that it is slightly greater than the interposed distance $D_{SP}$. As used hereinafter in the claims, the term "substantially equal to" shall be understood to include such applications. Under such conditions, the display case lighting fixture can be supported in its mounting position against the inner wall surfaces of opposing side walls 4 and 5, by axially generated forces applied via wall engaging members 21 and 22, as shown in FIG. 1 and 1A. Alternatively, the display case lighting fixture may be supported in such a mounting position by a pair of suction-cup type support brackets (not shown).

As best shown in FIG. 2, each halogen lighting device (e.g. 16A) includes an electrical socket 24 and a halogen light bulb 25. Each of these halogen lighting devices are connected in parallel with a direct current power supply 26 using electrical wiring 27 in a manner well known in the lighting art. In the illustrative embodiment, housing 11 is realized as an extruded tube made from a lightweight metal such as aluminum, although it is understood any fire-retardant plastic or like material can be used with excellent results. As shown in FIGS. 2 and 2A, housing 11 has a pair of spaced apart parallel flanges 29 and 30 behind which flexible panels 31A, 31B . . ., can be slid into position and securely held in place. These panels are spaced apart so as to form housing apertures 13A, 13B . . ., described above. As shown in FIG. 2A, a cavity 32 is formed between the interspacing of each pair of adjacent panels and the walls of the extruded tube. Within each such cavity, a light reflector (e.g. 17A) is installed in a snap-fit or like manner. As shown in FIG. 2A, end cavities 33 and 34 are formed at the first and second housing end portions, for the purpose of securely supporting fixture length adjustment mechanisms 23 therewithin.

As illustrated in FIGS. 2A and 2B, first and second housing support elements 19 and 20 are each realized by an inner cylindrical tube 35 which is coaxially arranged within an outer cylindrical tube 36 and coupled thereto by a coil type spring 37. As shown in FIG. 2C, each outer cylindrical tube 36 is frictionally held within its respective end cavity. A first pin 38 is mounted within the interior end portion of the outer cylindrical tube and a second pin 39 is mounted within the interior end portion of the inner cylindrical tube. One end of coil type spring 37 is stationarily connected to inner cylindrical tube 35 by way of second pin 39 mounted within the interior end portion of the inner cylindrical tube. The other end of the coil type spring is threaded into (or through) first pin 38 as shown in FIG. 2C, so that the coil spring and thus the inner tube can be screwed into and out of the outer tube. With the above described structural arrangement installed within each housing end portion, two independent functionalities are provided to the display case lighting fixture of the present invention.

The first functionality is a rotable length adjustment mechanism for each housing support element 19 and 20. This mechanism allows the installer to increase or decrease the amount that the inner cylindrical tube projects from its respective housing end portion. This adjustment is achieved by simply rotating the inner tube with respect to the outer tube.

The second mechanism generates outwardly directed forces along the longitudinal axis of the housing and against the inner side wall surfaces of the display case when the inner cylindrical tube is pushed within the outer cylindrical tube and the coil-type spring is compressed in accordance with Hooke's flaw.

Together, these independent mechanisms permit the installer to simply adjust the overall length dimension $L_{LF}$ of the display case lighting fixture in order to accommodate the interpanel distance $D_{SP}$ of the display case and thus support the lighting fixture between opposing sidewalls, or even top and bottom wall panels, of a display case. Such fixture length adjustments are achieved by simply selecting $L_{LF}$ be slightly greater than $D_{SP}$ so that outwardly directed forces are generated along the longitudinal axis of the fixture housing when coiling spring(s) 37 are compressed.

Figure 3:
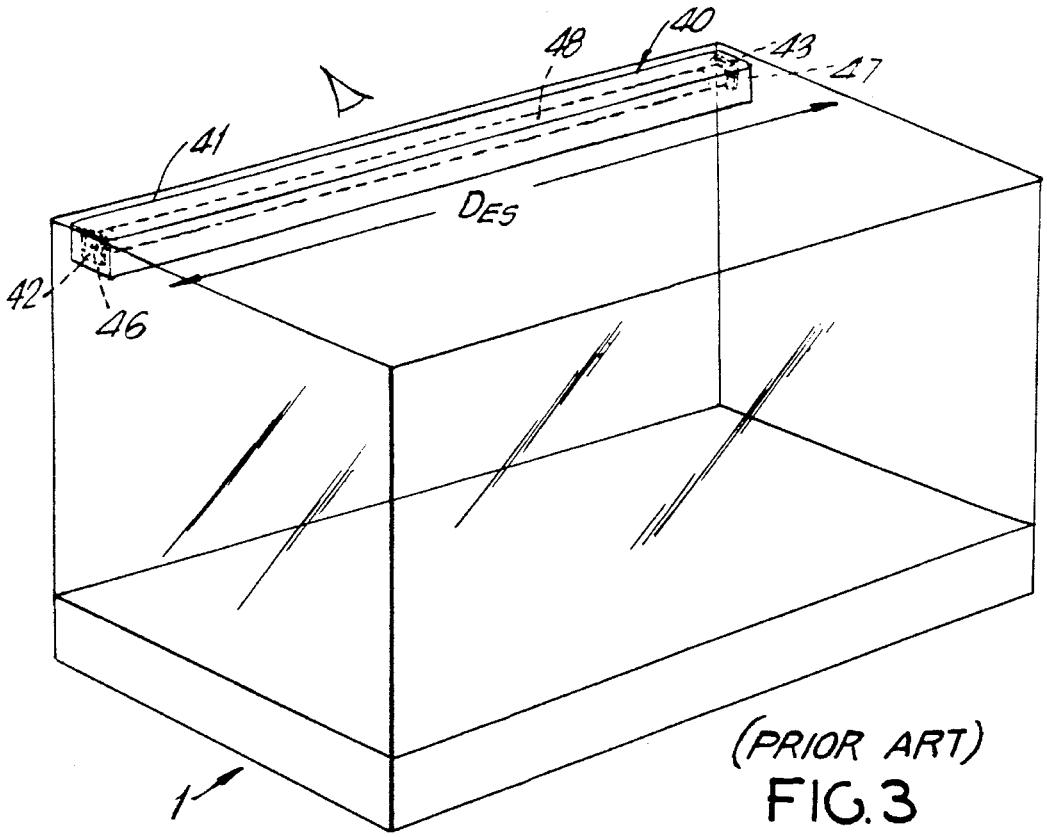
(PRIOR ART) FIG. 3
FIG. 3 is a perspective view of a conventional display case and a prior art fluorescent-type display case lighting fixture installed therein.
Figure 4:
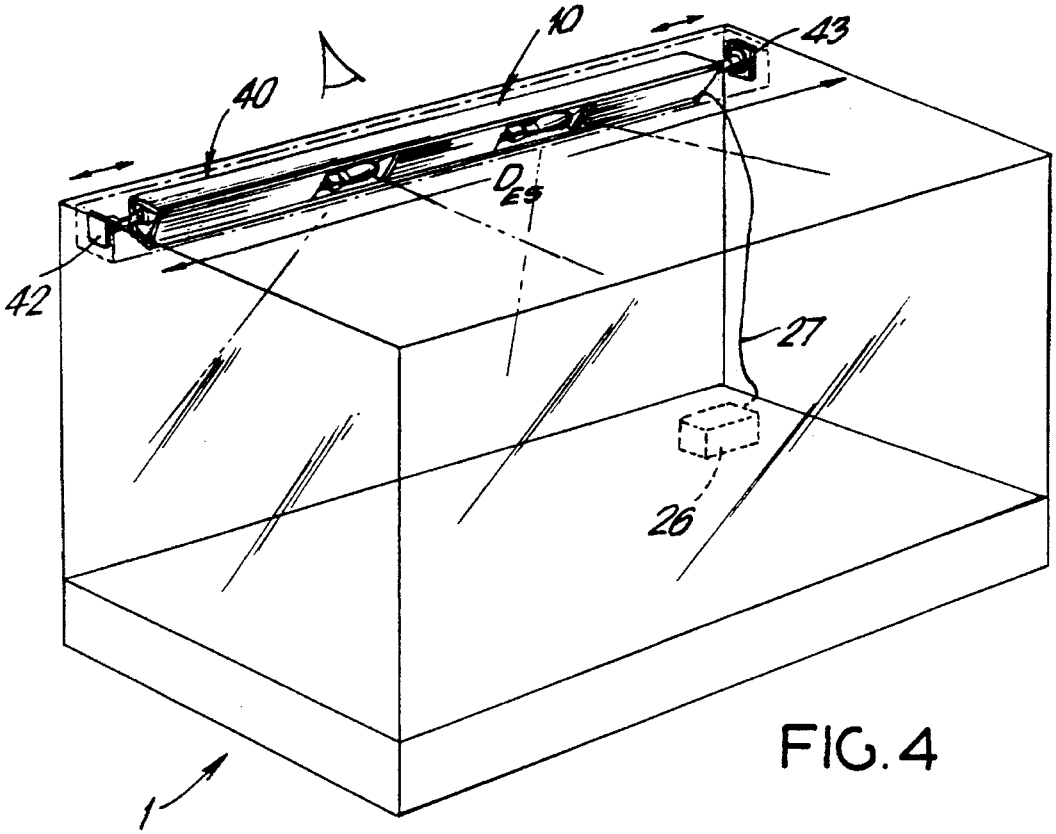
FIG. 4 is perspective view of the conventional display case of FIG. 3, in which the display case lighting fixture of the present invention is installed within a conventional fluorescent-type lighting fixture in order to simply convert the same into a halogen-type display case lighting fixture.

Having described the structure and function of the display case lighting fixture of the present invention, it is appropriate at this juncture to describe a novel method of converting a conventional fluorescent-type display case lighting fixture 40 shown in FIG. 3, into the halogen-type display case lighting system shown in FIG. 4.

In FIG. 3, an exemplary fluorescent-type display case lighting fixture 48 is shown installed within a conventional display case 1, similar to the one shown in FIG. 1. In general, fluorescent-type display case lighting fixture 40 comprises a housing 41 from which a pair of spaced-apart fluorescent tube support elements 42 and 43 extend. Each of these fluorescent light tube support elements contain electrical sockets having conductive terminals which establish contact with the conductive pins 46 and 47 disposed at opposite ends of a conventional fluorescent light tube 48 whenever the fluorescent light tube is installed in the electrical sockets in a manner well known in the art.

In accordance with method of the present invention, fluorescent light tube 40 is first removed from display case lighting fixture 40. The halogen-type display case lighting fixture 10 is then brought in proximity with display case lighting fixture 40 while the fluorescent light tube is removed therefrom. Then the length $L_{LF}$ of halogen-type display case lighting fixture 10 is adjusted to be slightly greater than the intersocket distance $D_{ES}$ measured between the inner planar faces of electrical sockets 42 and 43 in the fluorescent-type display case lighting fixture (e.g. $L_F=D_{ES}+2''$). Thereafter, side wall engaging members 21 and 22 of the halogen-type display case lighting fixture are manually pushed towards each other, thereby compressing coil-type springs 37 contained within the end portions of housing. In this shortened configuration, display case lighting fixture 10 is installed within the fluorescent-type display case lighting fixture 40 such that wall surface engaging members 21 and 22 engage the inner planar faces of electrical sockets 42 and 43, as shown in FIG. 4. In this mounting position, axially directed forces generated by coil-type springs 37 press the rubber surface engaging members 21 and 22 against electrical sockets 42 and 43 and securely support the halogen-type display case lighting fixture between the electrical sockets of the fluorescent-type display case lighting fixture. Thereafter, wiring 27 is routed through the display case and power supply 26 is mounted in a concealed manner.

Having performed the method hereof as described above, it is clear that fluorescent-type display case lighting fixtures can be simply and effectively converted into halogen-type display case lighting fixtures as shown in FIG. 4, and thus acquiring all of the functional advantages thereof. From the perspective of the installer, the application of the above-described method is as simple as changing a fluorescent light tube.

While the preferred embodiment of the present invention has been described in detail, it will be appreciated that numerous variations and modifications of the present invention will occur to persons skilled in the art. All such variations and modifications shall constitute the present invention as defined by scope and spirit of the appended claims to invention.

What is claimed is:

1. A display case lighting fixture supportable between the inner opposing wall surfaces of a display case, said display and lighting fixture comprising:

a housing having a longitudinal extent and first and second housing end portions;

light producing means disposed in said housing for producing light;

lighting focusing means disposed in said housing, for focusing said produced light to form a lighting pattern definable with respect to said housing;

first and second adjustable housing support elements extending substantially along said longitudinal extent from said first and second housing end portions, respectively, said first and second adjustable housing support elements having first and second wall engaging portions, respectively, each said wall engaging portion being adapted to engage one said inner opposing wall surface of said display case, and said first and second adjustable housing support elements being rotatably adjustable over a range of selectable positions along said longitudinal extent so that the distance between said first and second wall engaging portions can be adjusted to be substantially equal to the distance between said inner opposing wall surfaces, permitting each said wall engaging portion to engage one said inner opposing wall surface;

axial force producing means in cooperation with at least one of said first and second adjustable housing support elements, for producing axially directed forces along said longitudinal extent of said housing so that each said wall engaging portion frictionally engages against one said inner opposing wall surface of said display case so as to frictionally support said display case lighting fixture between said inner opposing wall surfaces of said display case.

2. The display case lighting fixture of claim 1, wherein said axial force producing means further comprises a first spring structure for retaining said first adjustable housing support element within at least a first portion of said housing over said selected range of positions, and a second spring structure for retaining said second adjustable housing support element within at least a second portion of said housing over said selected range of positions.

3. A display system for displaying merchandize, comprising:

(A) a display case having inner opposing wall surfaces; and (B) a display lighting fixture including:

(1) a housing having a longitudinal extent and first and second housing end portions, (2) light producing means disposed in said housing for producing light, (3) lighting focusing means disposed in said housing, focusing said produced light to form a lighting pattern definable with respect to said housing, (4) first and second adjustable housing support elements extending substantially along said longitudinal extent from said first and second housing end portions, respectively, said first and second adjustable housing support elements having first and second wall engaging portions, respectively, each said wall engaging portion being adapted to engage one said inner opposing wall surface of said display case, and said first and second adjustable housing support elements being rotatably adjustable over a range of selectable positions along said longitudinal extent so that the distance between said first and second wall engaging portions can be adjusted to be substantially equal to the distance between said inner opposing wall surfaces, permitting each said wall engaging portion to engage one said inner opposing wall surface; and (5) axial force producing means in cooperation with at least one of said first and second adjustable housing support elements, for producing axial forces along said longitudinal extent of said housing so that each said wall engaging portion frictionally engages one said inner opposing wall surface of said display case so as to frictionally support said display case lighting fixture between said inner opposing wall surfaces of said display case.

4. The display system of claim 1, wherein said axial force producing means further comprises a first spring structure for retaining said first adjustable housing support element within at least a first portion of said housing over said selected range of positions, and a second spring structure for retaining said second adjustable housing support element within at least a second portion of said housing over said selected range of positions.

* * * * *